US005314319A

United States Patent [19]

Nilsson et al.

[11] Patent Number: 5,314,319

[45] Date of Patent: May 24, 1994

[54] HYDRAULIC PUMP FOR A VEHICLE ENGINE

[75] Inventors: Per-Inge Nilsson, Vagnhärad; Per-Anders Bülow, Södertälje, both of Sweden

[73] Assignee: Saab Automobile Aktiebolag, Sweden

[21] Appl. No.: 946,294

[22] PCT Filed: Mar. 3, 1992

[86] PCT No.: PCT/SE92/00131

§ 371 Date: Oct. 30, 1992

§ 102(e) Date: Oct. 30, 1992

[87] PCT Pub. No.: WO92/15773

PCT Pub. Date: Sep. 17, 1992

[30] Foreign Application Priority Data

Mar. 5, 1991 [SE] Sweden ..... 9100635

[51] Int. Cl.[5] ..... F01C 1/10

[52] U.S. Cl. ..... 418/170; 418/133; 418/171

[58] Field of Search ..... 418/166, 169, 170, 171, 418/133

[56] References Cited

U.S. PATENT DOCUMENTS 3,303,783 2/1967 Neubauer ..... 418/166
4,382,756 5/1983 Chronowski et al. ..... 418/133
5,085,187 12/1992 Black ..... 123/196 R
5,215,165 6/1993 Torii ..... 418/171

FOREIGN PATENT DOCUMENTS 0376901 7/1990 European Pat. Off. .
2836766 3/1990 Fed. Rep. of Germany .
668805 1/1989 France .
0115485 7/1984 Japan ..... 418/133

*Primary Examiner*—Richard A. Bertsch
*Assistant Examiner*—Charles G. Freay
*Attorney, Agent, or Firm*—Ostrolenk, Faber, Gerb & Soffen

[57] ABSTRACT

A hydraulic pump in the form of an oil pump for a vehicle engine has both its pinion, which is driven by the engine's crankshaft, and a ring-gear, which cooperates with the pinion, incorporated in an end-cover fastened to the end of the engine block. A cap is inserted in a collar on the side of the end-cover facing away from the engine and is only held in position there by means of a locking ring, which engages with a groove in the collar and presses the cap toward the engine. Outside the oil pump, a partly socket-shaped belt pulley is mounted on the crankshaft and its socket-shaped portion substantially grips the collar. Fitting and removal are thus simplified and engine overall length reduced. Simplified sealing also reduces oil leakage risks.

20 Claims, 4 Drawing Sheets

HYDRAULIC PUMP FOR A VEHICLE ENGINE

BACKGROUND OF THE INVENTION

The present invention concerns a hydraulic pump, especially an oil pump, for a vehicle engine, provided with a pinion driven by the engine's crankshaft and with a centre-displaced ring-gear cooperating with it, and the pinion and the ring-gear are enclosed in a pump housing formed by an end cover fastened to the engine and another part secured thereto, of which at least the end cover has an aperture for the crankshaft.

The use of an oil pump in the form of a gearpump which is installed concentrically about, and is driven by, the engine's crankshaft is known for vehicle engines with pressure lubrication system. According to a usual design, the oil pump gear-wheel is placed in a separate pump housing which is bolted firmly to sealing contact with the outside of an end cover which is placed on one end of the engine block and creates together with the sides of the engine block part of the seal of the inside of the engine. This end-cover preferably forms a transmission cover which contains the engine's camshaft transmission and possibly also its balance-shaft transmission, both of which are driven by a drive placed on the end of the crankshaft. Outside the oil pump, there has usually been outermost on the end of the crankshaft a belt pulley for driving various auxiliary units such as cooling-water pump, generator and steering servo-pump. In such cases the end of the crankshaft passes through both the end-cover and the separate pump housing, which have cooperating machined planar contact surfaces which have to be sealed against leakage from the oil pressurised in the oil pump. The conventional version of the separate pump housing with all the feed and delivery ducts integrated in the pump housing has given the pump housing irregular contours. The seal between the contact planes is provided by an O-ring which is fitted in a groove in the contact plane of the pump housing and follows the irregular contours of the oil pump. This design results in relatively time-consuming fitting and removal of the oil pump, as a number of screws placed around the periphery of the pump housing are required for the fixing and sealing contact of the pump housing on the end-cover. Fitting a separate pump housing on the outside of the engine block end-cover also increases the engine's overall length. The irregular seal also entails leakage risks, as the O-ring may spring out of its groove while being fitted.

According to U.S. Pat. No. 4,382,756, fixing a cap in a pump housing by means of a grooved ring with circular cross-section is known per se in a hydraulic pump. In such cases the cap covers the shaft end and provides its bearing. To ensure good pump function, internal parts of the pump are spring-loaded towards the cap, which is thus pressed outwards and held against the locking ring.

Also known in another context is the fitting of a circular end-cap to a turbo-unit by means of a locking ring which is bevelled so as to press the cap inwards. The intention is to make it possible to fit the cap in the desired rotational position relative to the turbo-unit housing.

The automotive industry is increasingly endeavouring to simplify manufacture and assembly, but none of the previously known solutions for gearpumps installed about crankshaft ends achieves the desired simplicity in the case of an engine-mounted hydraulic pump.

SUMMARY OF THE INVENTION

One object of the invention is to achieve a hydraulic pump which is intended for a vehicle engine and is simpler and quicker to fit than previously. Another object is to make it possible to reduce the overall length of a vehicle engine with a hydraulic pump placed around and driven by the engine's crankshaft. A further object is to simplify and improved the sealing of this type of hydraulic pump.

These objects are achieved according to the invention by the features described below. The hydraulic pump includes a pinion driven by the engine crankshaft and a ring gear around the pinion, the center of the gear being offset from the center of the pinion, and the interior of the ring gear engages the periphery of the pinion at one side of the ring gear for being driven to rotate by the pinion. The gears are enclosed within a housing. The housing includes an end cover which is on a housing of the engine. There is a collar extending from the end cover away from the engine. There is an end cap that is inside of and is supported by and is centered by the collar and is spaced away from the end cover so that the gears are between the end cover and the end cap. A locking ring is in engagement with the collar and with the end cap, and the locking ring has the ability to press the end cap toward the end cover, maintaining enclosure of the housing. The locking ring is so shaped and is engaged with an opening in the collar that is so shaped that the locking ring urges the end cap toward the end cover.

According to a particularly advantageous embodiment, the first part consists of an end-cover which together with the sides of the engine block encloses the inside of the engine laterally. This end-cover may preferably be a transmission cover which contains at least a transmission driven by the crankshaft. Using the end-cover of the engine block to form a pump housing which is closed by a cap secured only by locking ring allows substantially simpler fitting and removal than previously. The fact that the oil pump's axial enlargement of the engine can thus be reduced makes it possible to pack the parts belonging to the engine closer together in the axial direction, thus reducing the overall axial length of the engine. This has great advantages in that the engine can be made accessible even on vehicles with little engine space, and/or other equipment in available engine space can be packed tighter.

BRIEF DESCRIPTION OF THE DRAWINGS

The invention is explained below in greater detail by means of an embodiment example illustrated in the accompanying drawings, in which.

DESCRIPTION OF A PREFERRED EMBODIMENT

Figure 1:
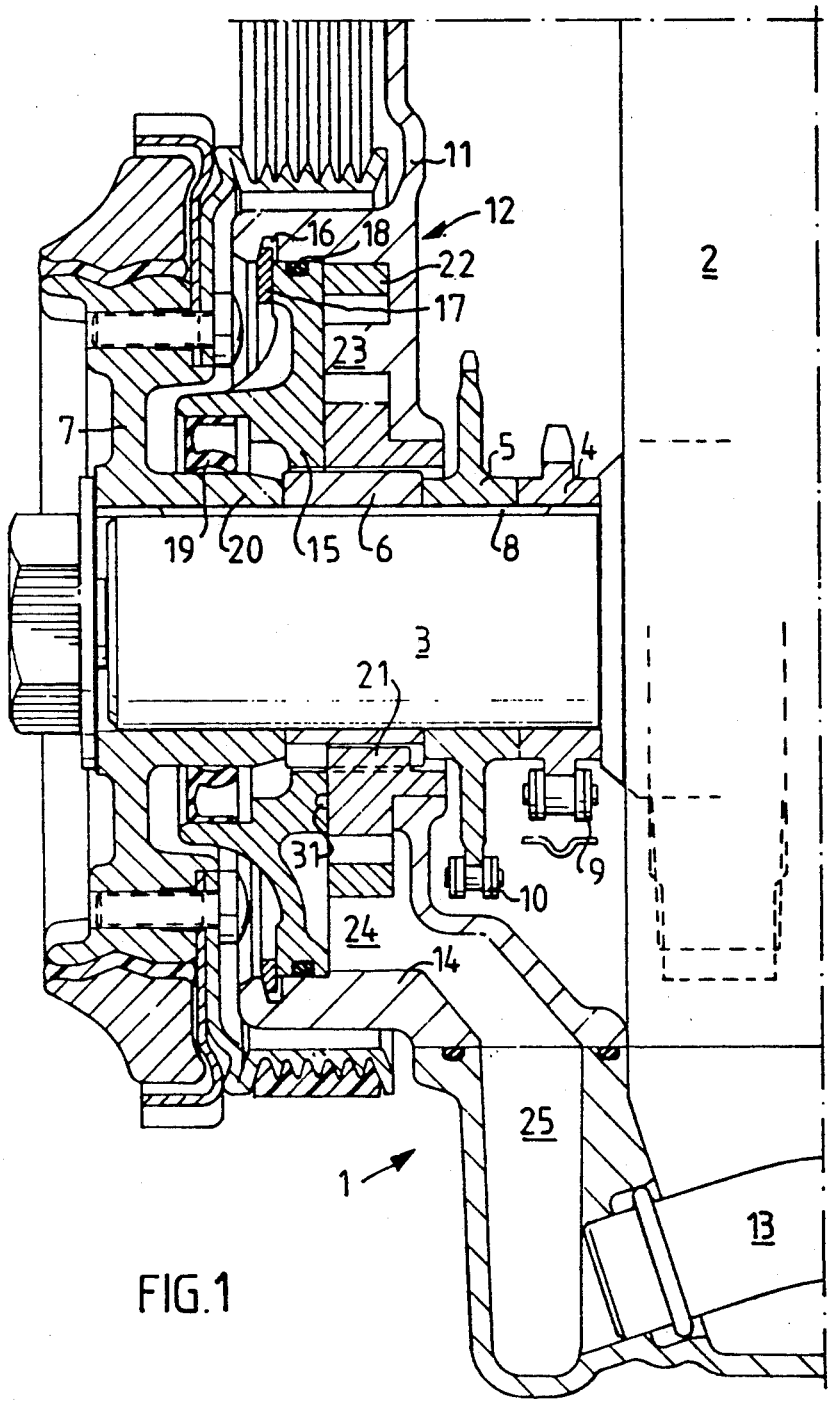
FIG. 1 shows a longitudinal section through an oil pump according to the invention, along the line I—I in FIG. 2.

In an internal combustion engine 1 illustrated in FIG. 1, one end of a crankshaft 3 mounted in the engine block 2 protrudes from the latter. Starting from the engine block 2, the crankshaft end successively bears an inner sprocket 4, an outer sprocket 5, a dog 6 and a belt pulley 7, all of which are fitted nonrotatably on the crankshaft end by means of a key 8. The sprocket 4 drives via a chain 9 the engine's two camshafts (not shown) and the sprocket 5 correspondingly drives via a chain 10 the engine's two balancing-shafts (not shown). These two chain transmissions run in the inside of the engine, are lubricated by the engine's oil lubrication system and are enclosed in a normal manner by an end-cover 11 fastened to the end of the engine block 2. The end-cover 11 accommodates an oil pump 12 which is driven by means of the crankshaft 3 and the dog 6 and is connected by a suction line 13 to an oil sump at the bottom of the engine.

As illustrated in FIG. 1, the end-cover 11 is provided with a surrounding collar 14 which faces away from the engine block 2 and supports internally a cap 15. A locking ring 17 fitted in a groove 16 in the collar 14 holds the cap 15 in position in the collar 14. The cap 15 seals partly by means of a seal 18 of the O-ring type placed in a circumferential groove in the cap, against the inside of the collar 14 on the end-cover 11 and partly by means of a seal 19 of the shaft seal type against a neck 20 of the belt pulley 7. Should there be no belt pulley on this crankshaft end, the cap 15 may cover the crankshaft end.

Figure 2:
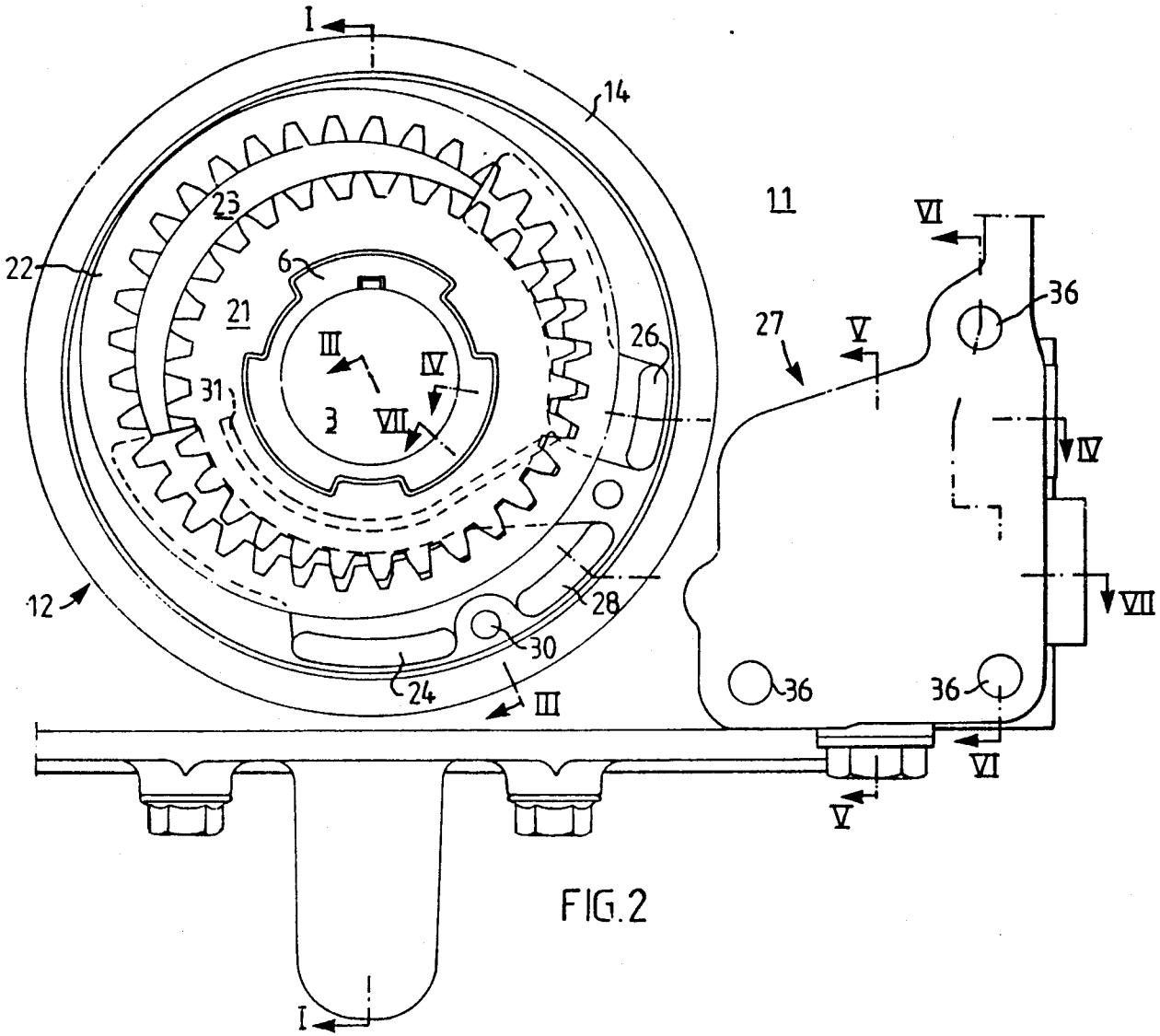
FIG. 2 shows a front view of an oil pump according to the invention, with cap removed.

In FIG. 2, the belt pulley 7 and the cap 15 have been removed to show more clearly the inside of the oil pump 12. As illustrated, the dog 6 meshes with a pinion 21 which meshes in turn with a centre-displaced internally toothed ring-gear 22. The pinion 21 and the ring-gear 22 have between them in a usual manner a crescent-shaped spacing device 23 which is here integral with the end-cover 11 and is situated in the same cavity as the pinion 21 and the ring-gear 22.

The suction side of the pump 12 is connected to the engine's oil sump via an inlet 24, a suction duct 25 and the suction line 13. From the pump outlet 26, oil on the pump's pressure side is supplied to the lubrication points in the engine via a pressure reducing valve 27 placed in the transmission cover 11. Oil returning from the pressure reducing valve 27 can reach the pump's suction side via a return port 28.

Figure 3:
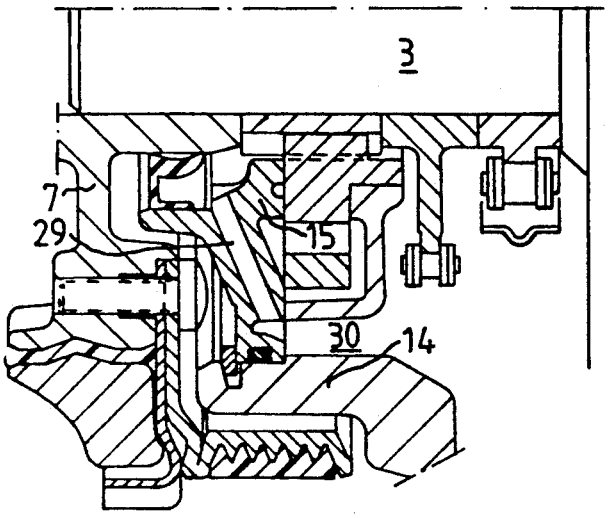
FIG. 3 shows a section along the line III—III in FIG. 2.
Figure 5:
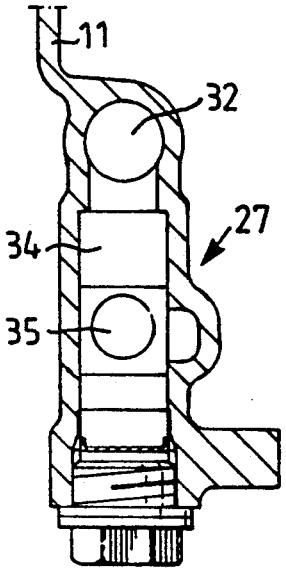
FIG. 5 shows a section along the line V—V in FIG. 2.

To reduce the load on the seal 19 between the cap 15 and the belt pulley 7 there is in the cap 15 (see FIG. 3) a drain duct 29 to remove leakage oil. The drain duct 29 is connected to the engine's crankcase and oil sump via a duct 30 in the end-cover 11.

On the inside of the cap 15 is a groove 31 which runs along the pinion 21 along part of the latter's periphery (see FIGS. 1 and 2) on the pump's suction side. This groove communicates with the pump's pressure side and has the function, by means of pressurised oil, of preventing air being drawn in radially from the crankshaft 3. The tightness of the pump is thus improved.

Figure 4:
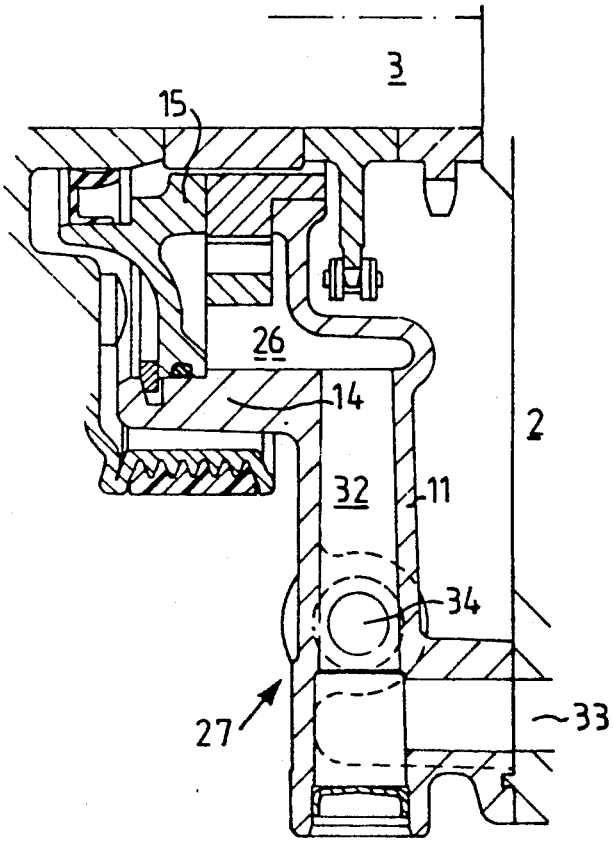
FIG. 4 shows a section along the line IV—IV in FIG. 2.
Figure 6:
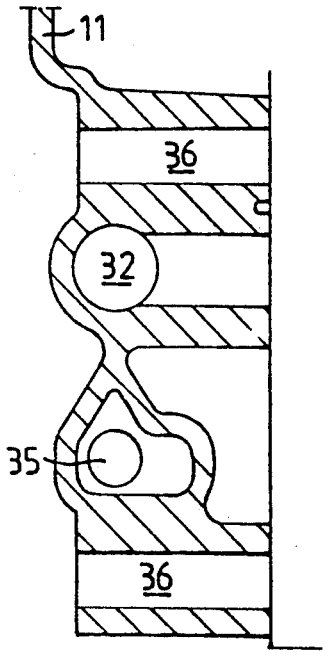
FIG. 6 shows a section VI—VI in FIG. 2.
Figure 7:
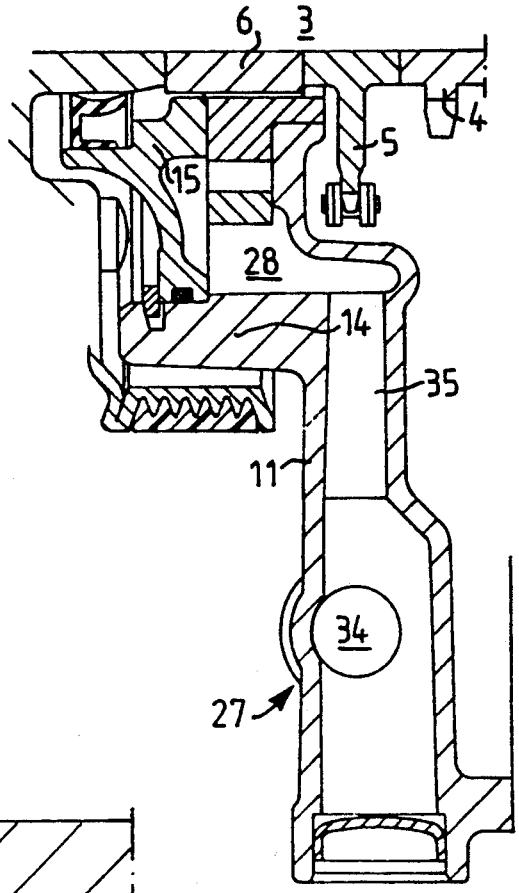
FIG. 7 shows a section along the line VII—VII in FIG. 2.
Figure 8:
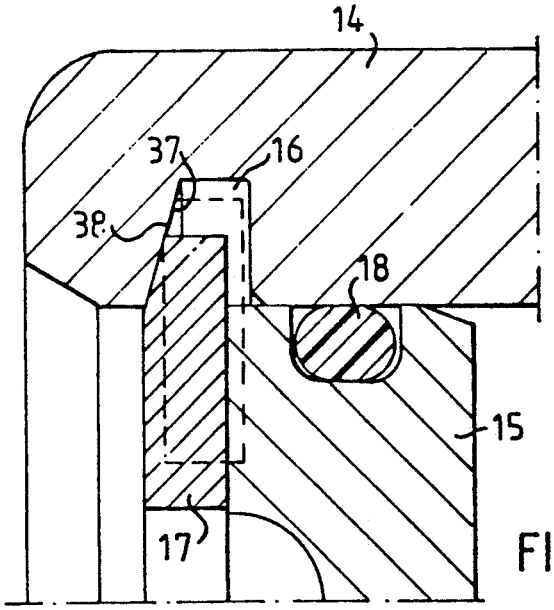
FIG. 8 shows an enlarged detail of FIG. 2.

As shown in FIG. 4, pressurised oil runs from the outlet 26 via a duct 32 and the pressure reducing valve 27 to a distribution duct 33 which is situated in the engine block 2 and from which it can in known manner be distributed in the engine. The duct 32, which is horizontal, communicates via a vertical duct 34 and a pressure control device not shown here in detail with a return duct 35 via which oil can make its way back to the return port 28 of the pump 12. For fastening to the engine block 2, the end-cover 11 is provided with a number of screw holes 36, some of which are shown in FIGS. 2 and 6. The more detailed design of the arrangement for fixing the cap 15 in the collar 14 of the end-cover 11 is illustrated in FIG. 8. The locking ring 17 is of the well-known Seger ring type and is held in place in the groove 16 by the fact that it springs radially outwards. The cap 15 is thus effectively locked in the collar 14, but is extremely easy to fit and remove. As illustrated, the wall 37 (on the left in FIG. 8) of the groove 16 is somewhat inclined so that the groove 16 broadens radially inwards. The locking ring 17 is of substantially rectangular cross-section but has in its radial outer portion a chamfer 38 which matches the angle of inclination of, and is intended to cooperate with, the wall 37. The result is that upon radial expansion of the locking ring 17 (depicted in broken lines) it endeavours to move inwards towards the engine block 2, thereby urging the cap 15 to move in the same direction and consequently press the parts of the pump together to create between them good axial contact without play. This means that the thickness of the cap 15, as also the placing of the groove 16 in the axial direction, can be varied within certain limits without jeopardising the functioning of the pump, with consequent great advantages both during manufacture and during fitting. It is according to the invention essential that the locking ring 17 and the groove 16 cooperate in such a manner that the locking ring, when it expands in the groove, simultaneously moves towards the engine. This can also be achieved with an unchamfered locking ring but the version with chamfered locking ring illustrated is more advantageous from the force transmission point of view and creates better contact between the locking ring and the cap. The function intended can also be achieved with shapes of locking ring and groove other than shown here.

As clearly shown in FIG. 1, the belt pulley 7 may be so designed as at least partly to enclose the collar 14, thus allowing it to be placed closer to the engine block 2 than was previously possible. This contributes to achieving a desired shorter overall engine length. The simplified design of the oil pump 12 is advantageous from both the manufacturing and the fitting points of view. The engine end-cover and the pump housing incorporated in it can preferably be preassembled as a unit, thereby reducing engine assembling time. All that has to be done after the pinion 21 mounted in the end-cover and accompanied by the end cap has been engaged with the dog 6 is to tighten the screws of the end-cover. Inspection and servicing of the hydraulic pump are also facilitated, as all that has to be removed after the belt pulley is the locking ring and the cap. Engine assembly is also facilitated by the fact that the pressure reducing valve 27 is also incorporated in the transmission cover 11.

We claim:

1. A hydraulic pump for a vehicle engine, comprising:

an engine crankshaft which defines a first rotation center;

a pinion for being driven by the crankshaft to rotate around the first rotation center;

a ring gear around the pinion and having a second rotation center which is displaced radially from the first rotation center, the ring gear having an interior including one side engaging the pinion for rotating the ring gear and having another side which is spaced away from the pinion; and a housing enclosing the pinion and the ring gear, the housing comprising:

an end cover fastened to the vehicle engine, wherein the end cover is a transmission cover, and containing at least one transmission driven by the engine crankshaft;

a collar extending away from the end cover;

an end cap inside and supported by and centered by the collar and spaced away from the end cover; and urging means extending between the collar and the end cap for urging the end cap toward the end cover for closing the cavity within the housing, the end cap closing the housing, whereby the ring gear and the pinion are enclosed in the housing.

2. The pump of claim 1, wherein the urging means comprises a locking ring in engagement with the collar and the end cap, the locking ring being adapted to press the end cap toward the end cover.

3. The pump of claim 1, wherein the urging means comprises a peripheral groove in the collar, and the groove opening toward the end cap;

a locking ring in the groove and extending also into contact with the end cap, the locking ring and the groove being so placed and the locking ring being shaped and adapted to urge the end cap toward the end cover.

4. The pump of claim 3, wherein the groove has a side thereof away from the end cover, and the groove side is inclined both in the radially inward direction and away from the cavity enclosed by the housing;

the locking ring being adapted to expand radially into the groove, and in so expanding, the locking ring engaging the inclined groove side for urging the locking ring toward the end cover, and the locking ring engaging the end cap for urging the end cap toward the end cover.

5. The pump of claim 4, wherein the groove broadens in its width between the sides of the groove in the direction radially inwardly of the collar.

6. The pump of claim 5, wherein the locking ring has a substantially rectangular cross section.

7. The pump of claim 6, wherein the locking ring has a chamfer which generally matches the incline of the inclined side of the groove, the chamfer being located at the side of the locking ring that is toward the inclined side of the groove.

8. The pump of claim 3, wherein the collar has an inside, and the cap has an external shell surface which matches the inside of the collar;

means sealing the collar to the cap where the inside of the collar and the cap shell surface are matched.

9. The pump of claim 3, wherein the end cover has an opening therethrough for the crankshaft.

10. The pump of claim 9, wherein the end cap has an opening therethrough for the shaft and the shaft passing through the cap opening;

means sealing the end cap to the shaft at the cap opening.

11. The pump of claim 10, wherein the end cap sealing means comprises a seal between the end cap and shaft.

12. The pump of claim 11, further comprising a pulley on the shaft, the pulley having a neck which extends along the shaft;

the cap extending around the neck of the pulley;

and the seal being between the neck of the pulley and the end cap.

13. The pump of claim 12, wherein the pulley has a portion which is radially external of and which surrounds the collar, defining a socket shaped part of the pulley, and the socket shaped part of the pulley and the collar are at least partly in the same radial plane.

14. The pump of claim 3, further comprising a spacing device in the space defined between the pinion and the ring gear, where the pinion and the ring gear are spaced apart.

15. The pump of claim 1, wherein the collar has an inside, and the cap has an external shell surface which matches the inside of the collar;

means sealing the collar to the cap where the inside of the collar and the cap shell surface are matched.

16. The pump of claim 15, wherein the sealing means comprises an O-ring seal between the inside of the collar and the cap shell surface.

17. The pump of claim 16, wherein the end cap has a peripheral groove therein for holding the O-ring seal.

18. The pump of claim 1, further comprising a spacing device in the space defined between the pinion and the ring gear, where the pinion and the ring gear are spaced apart.

19. The pump of claim 18, wherein the spacing device is crescent shaped.

20. The pump of claim 19, wherein the spacing device is integrated with the end cover.

* * * * *